United States Patent [19]

Wolkenstein

[11] Patent Number: 4,492,155

[45] Date of Patent: Jan. 8, 1985

[54] SIEVE BELT PRESS

[75] Inventor: Robert Wolkenstein, Liezen, Austria

[73] Assignee: Voest-Alpine Aktiengesellschaft, Vienna, Austria

[21] Appl. No.: 480,273

[22] Filed: Mar. 30, 1983

[30] Foreign Application Priority Data

Apr. 1, 1982 [AT] Austria ..... 1303/82

[51] Int. Cl.[3] ..... B30B 9/24

[52] U.S. Cl. ..... 100/118; 210/400

[58] Field of Search ..... 100/118, 119, 120; 210/386, 400, 401

[56] References Cited

U.S. PATENT DOCUMENTS

| | | | |
|---|---|---|---|
| 3,446,139 | 5/1969 | Coffelt | 100/118 |
| 4,142,461 | 3/1979 | Bastgen | 100/118 |
| 4,181,616 | 1/1980 | Bahr | 100/118 X |

*Primary Examiner*—Peter Feldman

*Attorney, Agent, or Firm*—Cushman, Darby & Cushman

[57] ABSTRACT

A sieve belt press includes two endless sieve belts which pass over a number of rolls. In the area in which the two sieve belts return separately, drive rolls are provided so that each sieve belt is driven separately. In addition, at least one further drive roll is provided in an area within which the sieve belts are passed in common over such further drive roll.

6 Claims, 1 Drawing Figure

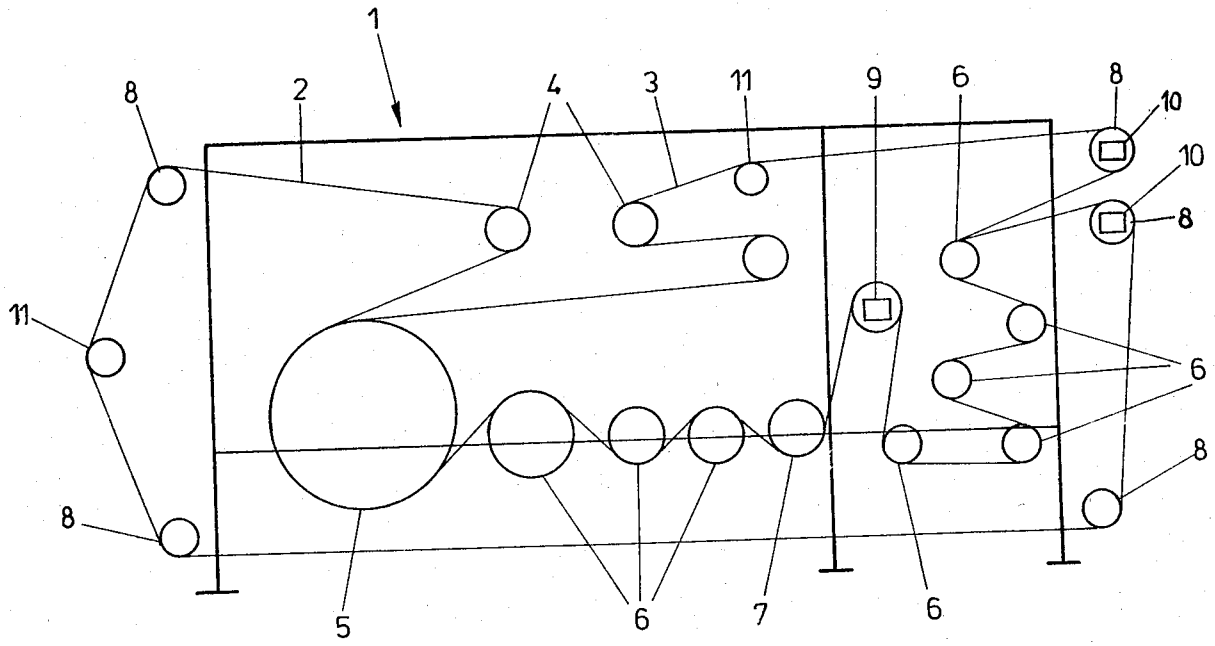
1
2
3
4
5
6
7
8
9
10
11

SIEVE BELT PRESS

The invention refers to a sieve belt press in which the material to be dewatered is pressed between two endless sieve belts and passed over a plurality of rolls one sieve belt being driven by at least two drive rolls. Such a sieve belt press is, for example, described in German Offenlegungsschrift No. 2 127 974. With such sieve belt presses it is also known to first subject the material to be dewatered to a preliminary dewatering step within a straining zone and subsequently within a tapering zone, within which both sieve belts are guided in a relatively converging manner, and to pass the material to be dewatered over dewatering drums, the first dewatering drum permitting, as a rule, not only penetration of water through the outer one of both sieve belts but also through the inner one of both sieve belts. It is further known to add to such a sieve belt press a further stage within which both sieve belts are, with frequent deflection of their transport direction, subjected to an increased mutual compression force, if desired. As a rule, such sieve belt presses have for at least one of both sieve belts a drive roll arranged in proximity of the discharge end of the sieve belt press and immediately acting on this sieve belt. Particularly for sludges of poor dewatering properties as well as for increased requirements with respect to the dewatering degree, a number of dewatering rollers or dewatering rolls exceeding the normal number of such rolls or rollers is required in the sieve belt press or the filter belt press. If the tension stress exerted by the belt drive within the sieve belts is acting on a plurality of dewatering rolls, this tension stress within the press becomes smaller with increasing distance from the drive roll on account of the frictional resistance.

The invention now aims at achieving greater uniformity of the tension stress within the sieve belt press or filter belt press and at thus improving the dewatering capacity of the sieve belt press. For solving this task, the invention essentially consists in that both sieve belts are, within the area at which the dewatered material is discharged, passed over drive rolls and in that in addition at least one roll is driven within that area within which both sieve belts are in common passed over rolls. It has surprisingly been found that the dewatering degree, particularly for sludges of poor dewatering characteristics, can substantially be increased. By driving, for example, a further roll embraced by both sieve belts, said roll being, in accordance with a preferred embodiment of the invention, separated by at least one non-drive roll from the roll driving a separately returning sieve belt, an improvement of the dewatering capacity from a residual humidity content of 32% down to a residual humidity content of 27% was measured.

By a preferred embodiment, in which a drive roll is in usual manner arranged in proximity of the discharge end of the belt press and in which the additional drive roll is arranged approximately in the middle of the row of dewatering rolls, the belt tension exerted by the drive means can be made more uniform, which means that the reduction in tension stress otherwise occurring within the first part can be avoided or adjusted, respectively.

The additional drive roll, which is preferably arranged in the middle area, is cooperating at its circumference with a sieve belt or filter belt being again driven at the discharge end. The outwardly located sieve belt not immediately acted upon by this additional drive roll can equally be directly driven by a further drive roll arranged in the middle area of the sieve belt press, thus further making more uniform the belt tension.

It is in correspondence with a preferred embodiment of the subject of the invention that at least two drive rolls comprise a separate and controllable drive means each. This arrangement provides beside the possibility of a general control of the belt speed the possibility to slightly change the circumferential speed of the second drive roll relative to the first drive roll so that an increased pressure force and thus a more intense degree of dewatering can be adjusted between both drive rolls. However, the drive rolls are, as a rule, driven with synchronous circumferential speed, which is, for example, possible by controllable gear engines and advantageously by using the torque-dependent speed elasticity of electromotors.

In the following, the invention is further illustrated with reference to an embodiment shown in the drawing.

In the drawing the sieve belt press or filter belt press is designated 1. Within this sieve belt press or filter belt press, two sieve belts or filter belts 2, 3 are guided along a closed path and tension rolls 4 are provided for adjusting the correct belt tension. The sieve belts or filter belts 2, 3 are combined in front of a first dewatering drum 5, the material to be dewatered being supplied into the gap between said two sieve belts or filter belts 2 and 3. Said two sieve belts or filter belts 2, 3 are subsequently passed over dewatering rolls 6 and 7. The deflection rolls for the sieve belts or filter belts are designated 8. At the discharge end of each sieve belt 2 and 3, respectively, a drive means 10 is provided for a deflection roll 8 over which the associated sieve belt is passed independently from the other sieve belt. A further drive roll, the drive means of which is designated 9, is cooperating with the sieve belt or filter belt 2. The The drive means 9, 10, not shown in detail, can be controlled and adjusted. In addition to the deflection rolls 8, comprising a drive means 10, and the further drive roll comprising the drive means 9, a dewatering roll 7 cooperating with the other sieve belt or filter belt 3 can be provided with a drive means in an analogous manner. In any case, the other sieve belt 3 is driven by a deflection roll 8 provided with a drive means in that area within which the sieve belt returns separately.

Control rolls for controlling the course of the belt are designated 11.

The drive rolls comprising the drive means 9 and 10 are driven, for example, by controllable gear engines not shown, to assume a synchronous belt speed. A minor deceleration of the circumferential speed of the drive roll 10 results in an increase of the pressure within the area of the interpositioned dewatering rolls 6 and can provide an additional improvement of the dewaterinng effect.

What is claimed is:

1. Sieve belt press, in which the material to be dewatered is pressed between two endless sieve belts which pass in common in a dewatering area over a plurality of common rolls and then separately over separate rolls in the area downstream of a discharge location characterized in that in the area downstream of the discharge location both sieve belts are passed over drive rolls and in that additionally at least one drive roll is power driven within the dewatering area within which the sieve belts are in common passed over common rolls.

2. Sieve belt press according to claim 1 characterized in that at least one of the drive rolls, over which both sieve belts are passed in common, is located within a middle area of a group of said common rolls.

3. Sieve belt press according to claim 1 characterized in that at least two drive rolls each comprise a separate and controllable drive means.

4. Sieve belt press according to claim 1, characterized in that the drive rolls are separated one from the other by at least one non-drive roll.

5. In a sieve belt press: two endless sieve belts each guided by rolls in an endless path, the paths of the belts coinciding with each other in a dewatering portion in which the belts are in contact with each other and pass together over a plurality of common rolls, said dewatering path portion having a supply end for receiving material to be dewatered and a discharge end for discharging dewatered material, and each belt after leaving said discharge end of said dewatering path portion entering a second path portion in which the respective belt passes over a separate plurality of rolls, at least one of the rolls in said dewatering portion and at least one of the rolls in the second path portion in proximity to the discharge end of said dewatering path portion being a drive roll driven by a power source.

6. A sieve press as in claim 5 wherein the dewatering path portion there is a non-drive roll disposed between the power-driven drive roll and the discharge end of the dewatering path portion.

* * * * *